United States Patent [19]

Bertolette et al.

[11] 4,337,809

[45] Jul. 6, 1982

[54] LOG SPLITTER

[76] Inventors: Robert K. Bertolette, 52 Ivy Cir., Norristown, Pa. 19403; John E. Bertolette, 259 Graterford Rd., Schwenksville, Pa. 19473

[21] Appl. No.: 180,982

[22] Filed: Aug. 25, 1980

[51] Int. Cl.[3] ..... B27L 7/00

[52] U.S. Cl. ..... 144/193 A; 144/3 K; 254/104

[58] Field of Search ..... 144/3 K, 184, 185, 175, 144/193 A, 193 R, 193 E; 254/104; 83/870, 874

[56] References Cited

U.S. PATENT DOCUMENTS

| | | | |
|---|---|---|---|
| 3,974,867 | 8/1976 | Poutas, Jr. | 144/193 E |
| 4,019,548 | 4/1977 | Lenderink et al. | 144/184 |
| 4,076,061 | 2/1978 | Greeninger | 144/193 A |
| 4,103,724 | 8/1978 | Braid | 144/193 E |
| 4,143,692 | 3/1979 | Traben | 83/874 |
| 4,153,088 | 5/1979 | King et al. | 144/193 A |

*Primary Examiner*—W. D. Bray

*Attorney, Agent, or Firm*—Joseph W. Molasky

[57] ABSTRACT

A log splitter in which a log is fed along a path of travel for splitting into a plurality of pieces is provided with a splitting mechanism which includes a main splitter arranged with a cutting edge facing the forward end of the log and formed by a straight-sided wedge construction, and a plurality of cutting knives which extend transversely to the main splitter with cutting edges facing the forward end of the log, the cutting knives being spaced apart relative to one another to define shearing compartments into which the log is fed as it is being split into pieces.

16 Claims, 7 Drawing Figures

LOG SPLITTER

BACKGROUND AND SUMMARY OF THE INVENTION

The log splitters in general use today have several disadvantages. Firstly, they are very cumbersome to operate and are incapable of achieving high production rates. Also, the prior art log splitters jam up easily primarily because of the type of cutting wedges used by these devices.

The log splitter in accordance with the invention overcomes the above-discussed disadvantages of the prior art devices and provides a reliable and productive device by reason of the use of a novel splitting mechanism. More specifically, the splitting mechanism used in the log splitter of the invention includes a main splitter arranged with a cutting edge facing the forward end of a log fed along a path of travel with the cutting edge being formed by a straight-sided wedge construction. The splitting mechanism also comprises a plurality of cutting knives extending generally transversely to the main splitter and providing cutting edges facing the forward end of the log. The cutting knives are spaced apart relative to one another to define shearing compartments into which the log is fed as it is being split into pieces. The cutting edges of the cutting knives are also formed by a straight-sided wedge construction.

In accordance with additional features of the invention, the main splitter is constructed of a two-stage cutting edge arrangement to lessen the force on the splitting mechanism and to thereby lessen the power requirements to split larger diameter logs. The straight-sided wedge construction used in the main splitter eliminates binding or jamming of the log between the main splitter and a side plate positioned at the other end of the cutting knives.

In accordance with a further feature of the invention the cutting knives are constructed and arranged with their cutting edges extending at an angle to the main splitter so as to urge the wood against the main splitter as it is fed through the splitting mechanism. Also, the cutting knives are arranged in a diverging relation to allow for separation of the log pieces as they are split to thereby prevent binding or jamming thereof during the splitting operation.

A still further feature of the invention is the provision of a side plate spaced apart from the main splitter and having a cutting edge which aids in the splitting operation. The side plate extends in a diverging relationship with respect to the main splitter to avoid jamming of the log pieces being split.

DETAILED DESCRIPTION OF THE PREFERRED EMBODIMENT

Figure 1:
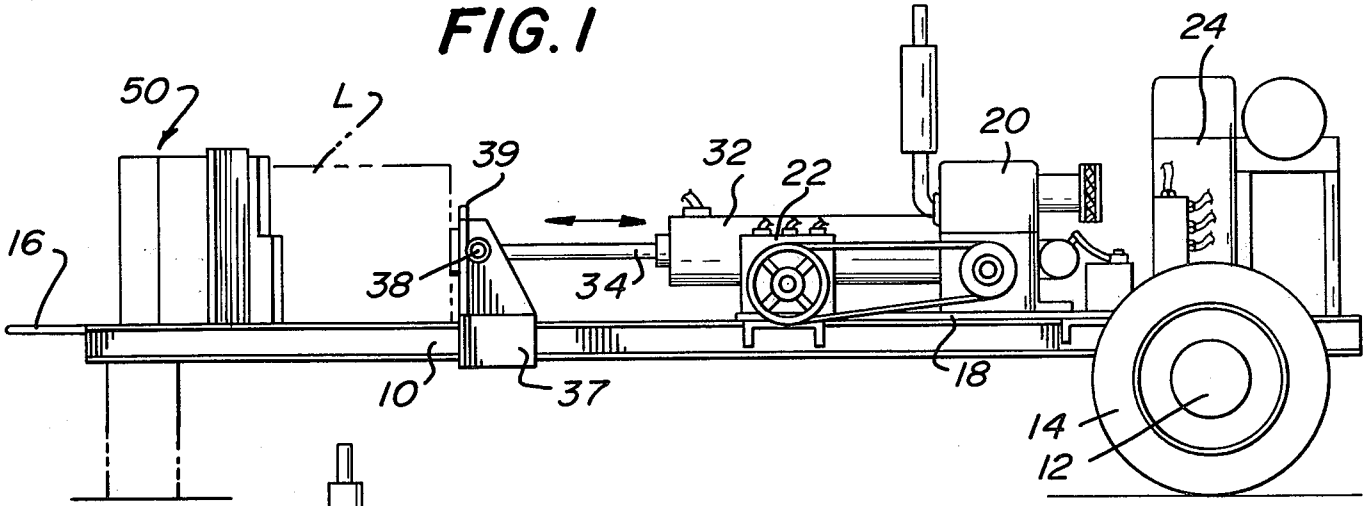
FIG. 1 is a side elevation of one side of the log splitter in accordance with the invention.

The log splitter in accordance with the invention is shown in the Drawings as being mounted on a portable structure including an I-beam frame 10 secured at one end on a horizontally extending axle 12 supported on wheels 14. The other end of frame 10 is provided with a conventional towing hitch 16. In use, the towing end of frame 10 is supported on blocks or the like with frame 10 extending generally horizontally as shown in FIGS. 1 and 2.

Figure 3:
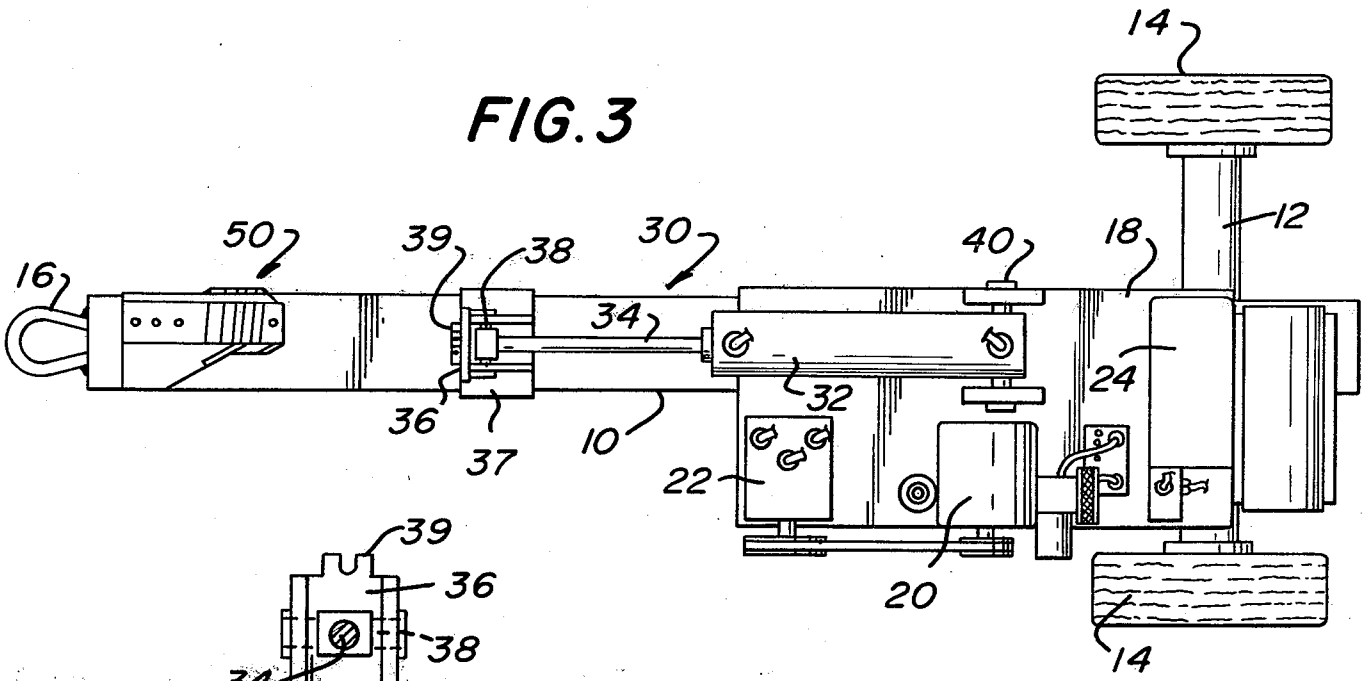
FIG. 3 is a top plan view of the log splitter as shown in FIG. 1.
Figure 4:
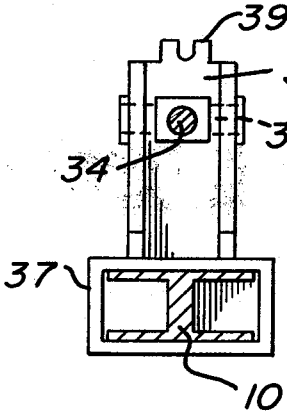
FIG. 4 is a sectional view taken on line 4—4 of FIG. 2.

A generally rectangular mounting plate 18 is welded on the top of frame 10 in the region of axle 12 and has supported thereon an internal combustion engine 20, a pump 22, and a control valve assembly 24. Pump 22 is driven by engine 20 and is controlled by the valve assembly 24 which functions to control the flow of hydraulic fluid for controlling the operation of a hydraulic ram means 30. Hydraulic ram means 30 comprises a cylinder 32, a piston rod 34, and a ram head 36 which is connected to the free end of piston rod 34 at a pivot pin 38. There is provided a pivot mounting 40 for the closed end of cylinder 32 as best shown in FIG. 3. Ram head 36 is guided for movement along frame 10 by means of a base 37 slidably mounted on frame 10 as shown in FIG. 4.

Figure 2:
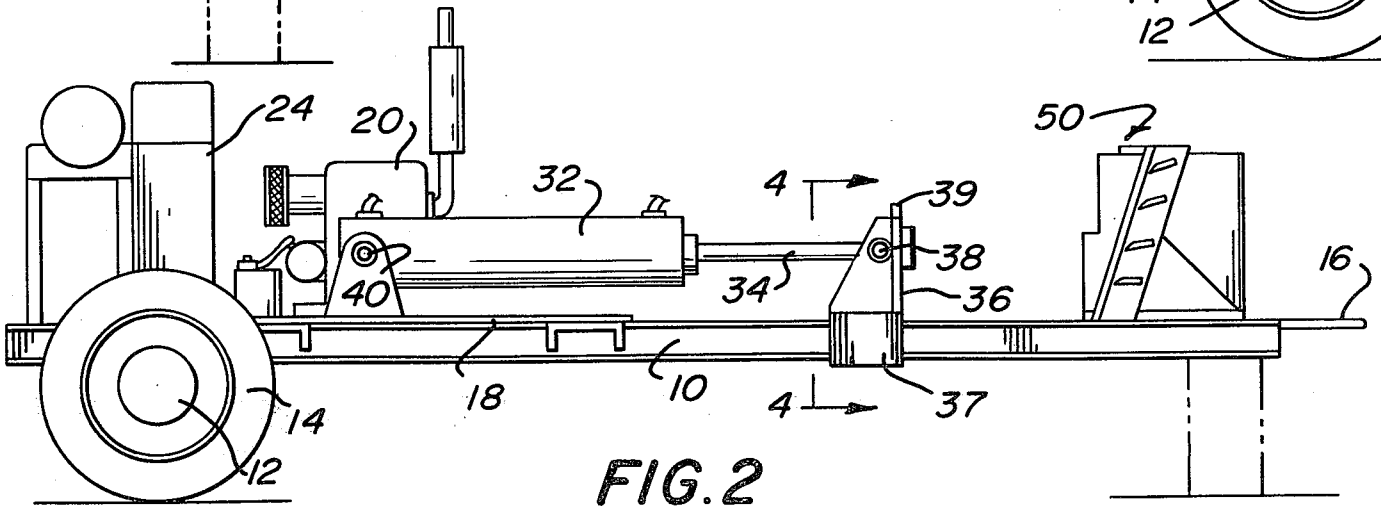
FIG. 2 is a side elevation of the other side of the log splitter in accordance with the invention.

The hydraulic ram means 30 and the pump operated actuating means therefor are conventional and function to move the ram head 36 back and forth across frame 10, as indicated by the arrows in FIG. 1, under the control of the pumped hydraulic fluid as it moves into and out of the cylinder 32. This hydraulic ram operation is conventional in the art.

The novel log splitting mechanism in accordance with the invention is mounted on frame 10 adjacent towing hitch 16 and in alignment with ram head 36 so that a log "L" can be fed through the log splitting mechanism by means of the hydraulic ram means 30. Thus, as piston rod 34 is caused to be extended from cylinder 32, ram head 36 is moved toward the log splitting mechanism and will drive log "L" into and through the log splitting mechanism as ram head 36 continues to move in this direction. It is during this movement that the log splitting action, as will be described hereafter, takes place. The above-described mechanisms function as means for feeding a log along a path of travel in which the log is split into a plurality of pieces.

Ram head 36 is provided with a hitch means 39 adapted to be engaged by a cable or the like for use in pulling a log away from the log splitting mechanism should a log become stuck or misaligned. To this end, the cable is wrapped around the log and secured to the hitch means 39.

Figure 7:
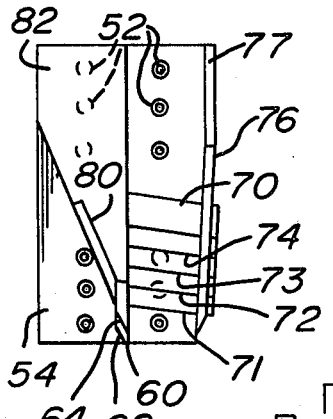
FIG. 7 is a top plan view of the splitting mechanism shown in FIG. 5.
Figure 6:
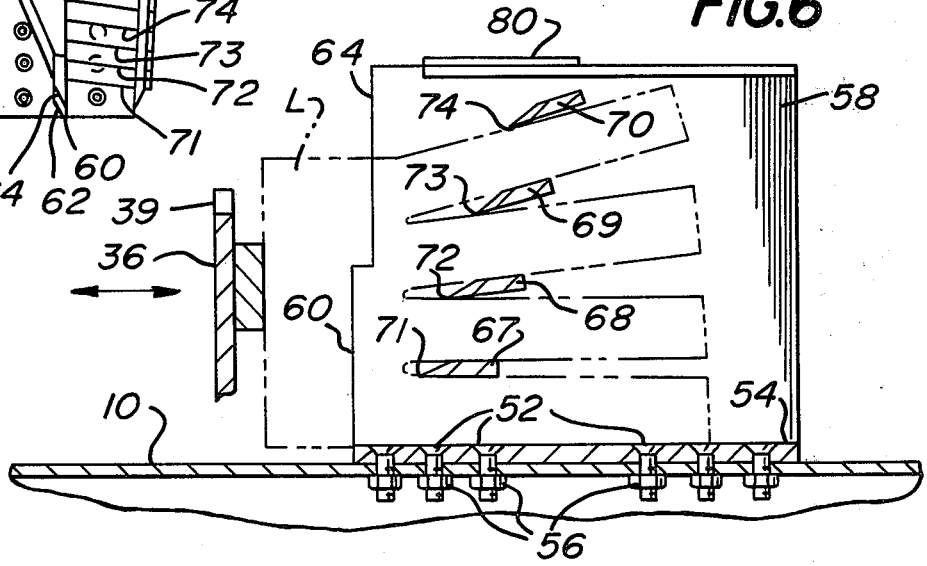
FIG. 6 is a view taken on line 6—6 of FIG. 5.

The log splitting mechanism in accordance with the invention is indicated at 50 and is securely mounted on frame 10 by means of a plurality of bolts 52 received in countersunk holes in a base plate 54. The bolts 52 extend through holes in frame 10 aligned with the countersunk holes in base plate 54 for engagement with suitable nuts 56 (FIG. 6). It is important that log splitting mechanism 50 be securely mounted since it is subjected to very high forces during a log splitting operation and, to the end, twelve mounting bolts 52 and nuts 56 are used (FIG. 7).

Log splitting mechanism 50 includes a main splitter 58 welded at its bottom end onto base plate 52 to extend perpendicularly therefrom in an upright position. Main splitter 58 has a cutting edge facing the forward end of the log fed along the path of travel for splitting, said cutting edge being formed by a two stage, straight-sided wedge construction. As used herein, the term "straight-sided wedge construction" describes a wedge comprised of a straight side and a beveled surface joined at the cutting edge. The straight side extends along the path of travel of the log being split and the beveled surface extends at an acute angle to the straight side.

One portion of the cutting edge of main splitter 58 is indicated at 60 and comprises a beveled surface 62. The other portion of the cutting edge of main splitter 58 is indicated at 64 and comprises a beveled surface 66. Cutting edge portion 60 is formed at a location forwardly of cutting edge portion 64, as is best shown is FIG. 6, in the direction of travel of the log so that the portion 60 contacts the forward edge of the log prior to contact of the log by portion 64. This arrangement lessens the forces that are applied to the main splitter 58 during a log splitting operation and thereby reduces the power requirements of the log splitter. Log splitting mechanism 50 also comprises four cutting knives 67, 68, 69 and 70, arranged to extend generally transversely to main splitter 58 and provided with cutting edges 71, 72, 73 and 74, respectively, facing the forward edge of a log to be split. Cutting edges 71–74 are formed by a straight-sided wedge construction.

Figure 5:
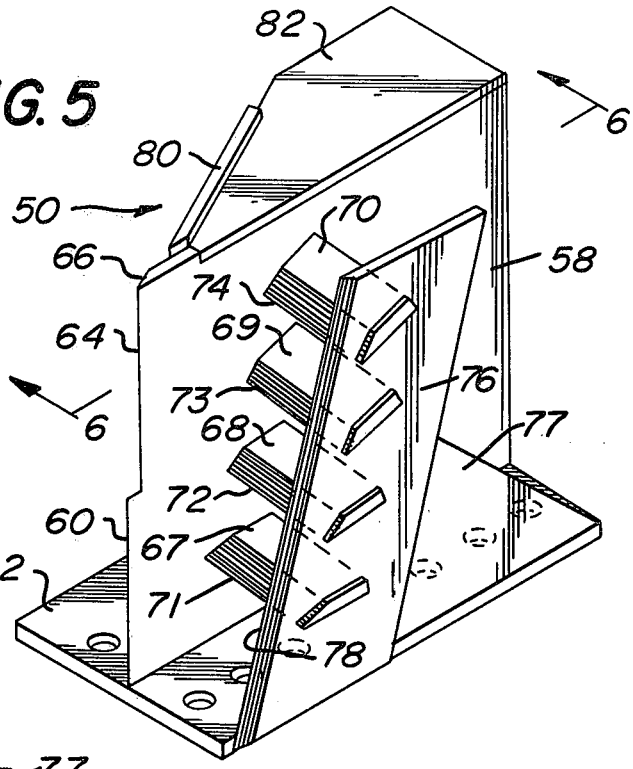
FIG. 5 is a perspective view of the splitting mechanism incorporated in the log splitter in accordance with the invention.

Cutting knives 67–70 project from the straight side of main splitter 58 and have one end welded thereto with their other ends being supported by a side plate 76. Side plate 76 extends along the path of travel of the log in spaced apart relation to main splitter 58 and receives the ends of cutting knives 67 to 70 in cutout portions thereof, the arrangement being such that cutting knives 67 to 70 extend through side plate 76 and are secured thereto by continuous welds extending completely around each of the cutting knives 67–70 to thereby provide a very secure support therefor. Side plate 76 is securely welded at its bottom end onto base plate 62 and is further supported by a brace plate 77 as is best shown in FIG. 5. Side plate 76 has a cutting edge 78 facing in the same direction as the cutting edge of main splitter 58 and formed by a straight-sided wedge construction. The straight side of side plate 76 faces the straight side of the main splitter 58 with the planes of said straight sides diverging slightly relative to one another in the direction of travel of a log through the log splitter as is best shown in FIG. 7. Cutting edge 76 is arranged to be inclined to the vertical as shown in FIG. 5 so as to engage a log progressively as it is fed through the log splitting mechanism 50.

Main splitter 58, cutting knives 67–70 and side plate are preferably made of a spring steel capable of withstanding the high forces and wearing action involved in a log splitting operation. The use of a spring steel minimizes the need for sharpening the cutting edges.

Log splitting mechanism 50 also comprises a throwaway or log spreader plate 80 supported in an upright position on base plate 52 to extend at an angle to main splitter 58 from the side opposite the cutting knives 67–70. Throwaway plate 80 extends in the direction of travel of a log at an acute angle of about 30°–35° to main splitter 58 from a location spaced rearwardly of cutting edge 74 as is shown in FIGS. 5 and 7. By this arrangement, throwaway plate 80 functions to move quickly away from main splitter 58 that portion of the log not passing into the cutting knives 67–70 to the side of main splitter 58. This action on the log will cause the log to break apart at an early stage in the splitting operation to reduce the amount of the log subjected to the splitting forces of the various cutting knives and the like. Throwaway plate 80 is braced by a brace plate 82 extending horizontally from the top of main splitter 58 to throwaway plate 80 as is shown in FIGS. 5 and 7.

Cutting knives 67–70 cooperate with main splitter 58, side plate 76 and base plate 52 to define four shearing compartments (See FIG. 6). Thus, a log "L" being fed through log splitting mechanism 50 will be split into at least four pieces of approximately the same size as is illustrated in FIG. 6. By proper guidance of the log into the log splitting mechanism 50, the remaining portion of the log will be discarded to the side of main splitter 58 by action of throwaway plate 80 although possibly a small portion of the log will be discarded to the side of side plate 76. Preferably, however, the user of the device will guide these logs accurately into the log splitting mechanism 50 so that little if any log is cut by the side plate 76.

In accordance with a feature of the invention, cutting edges 71–74 of knives 67–70 extend from main splitter 58 at slightly less than a right angle into the path of travel of a log. This is shown best in FIG. 7. By reason of this arrangement, cutting edges 71–74 act on a log being fed into splitting mechanism 50 in a manner to cause the log to move (by a camming action) toward main splitter 58. This improves the cutting action, prevents jamming and minimizes the wasting of pieces of the log.

In accordance with another feature of the invention, cutting knives 67–70 are arranged with the straight sides of their wedge construction facing downwardly toward base plate 52 with these straight sides being arranged to extend in planes such that the straight sides of any two adjacent cutting knives diverge relative to one another. This arrangement is best shown in FIG. 6 and allows for separation of adjacent split log pieces to prevent binding or jamming thereof in the device. The diverging relation between the straight sides of main splitter 58 and side plate 76 also contributes to the prevention of binding or jamming of log pieces being cut.

Another feature of the invention is that cutting knives 67–70 are arranged with their cutting edges 71–74 set back progressively from one another along the path of travel of the log (see FIGS. 5 and 6). By this arrangement, a log being fed through log splitting mechanism 50 will come into contact with cutting edges 71–74 successively. Thus, the load is applied to the ram head 36 progressively to provide a smoother cutting action.

In operation, a log L is placed on the I-beam frame 10 at a location between the hydraulic ram head 36 and the log splitting mechanism 50. The log is fed into the log splitting mechanism 50 by operation of the hydraulic ram means to extend the piston rod 34 and move ram head 36. As the log moves to the right as viewed in FIG. 2, its forward end initially contacts cutting edge portion 60 of main splitter 58 and the log then contacts the cutting edge portion 64 of main splitter. At this point an excess log portion could contact the bottom end of the cutting edge 78 of side plate 76. Continued travel of the log into the splitting mechanism 50 will result in a part of the log being broken away by the action of the throwaway plate 80. This will normally occur prior to the point at which the forward end of the log comes into contact with cutting edge 71 of cutting knife 67. The log will then successively come into contact with the cutting edges 71, 72, 73 and 74 of the cutting knives 67–70, and be split into at least four pieces as shown in FIG. 6.

The above-described splitting action is achieved without any binding or jamming of a log by reason of the design features of the log splitting mechanism described above. Moreover, very high production rates can be achieved by the use of the log splitting mechanism in accordance with the invention. For example, using a log splitter in accordance with the invention, a cord of wood has been cut by two men in a period of approximately one hour.

It will be apparent that various changes may be made in the construction and arrangement of parts without departing from the scope of the invention as defined by the following claims. For example, it will be understood that the log splitting mechanism can be made in various sizes and is adaptable to various different sized machines. Also, there may be provided a different number of splitting compartments.

What is claimed is:

1. In a log splitter having means for feeding a log along a path of travel in which the log is split into a plurality of pieces, the improvement comprising:

a splitting mechanism which includes a main splitter arranged with a cutting edge facing the forward end of a log fed along said path of travel, said cutting edge of said main splitter being formed by a straight-sided wedge construction having a straight side and a beveled surface joined at said cutting edge, and a plurality of cutting knives on one side of said main splitter extending generally transversely to said main splitter with cutting edges facing the forward end of a log fed along said path of travel, said cutting knives being spaced apart relative to one another in the direction transverse to the path of travel of the log to define at least three shearing compartments through which a log is fed as it is being split into pieces.

2. A log splitter according to claim 1 wherein the straight side of said straight-sided wedge construction forming the cutting edge of said main splitter extends along said path of travel of said log and faces said shearing compartments, said cutting knives being arranged to project from said straight side of said main splitter.

3. A log splitter according to claim 2 wherein the beveled surface of said straight-sided wedge construction forming the cutting edge of said main splitter extends at a substantial angle to said straight side thereof so that a log fed along said path of travel is spread apart quickly after a short distance of movement thereof into the splitting mechanism to effect a breaking away of the log portion on one side of the main splitter.

4. A log splitter according to claim 2 wherein the cutting edge of the main splitter has two portions, one of which is forward of the other along said path of travel and aligned with an outermost shearing compartment so that said one splitter portion initially contacts an outer edge of the forward end of the log fed along said path of travel prior to the other splitter portion.

5. A log splitter according to claim 2 wherein said cutting edges of each of said cutting knives are formed by a straight-sided wedge construction.

6. A log splitter according to claim 5 wherein said cutting edges of said cutting knives extend from said main splitter at less than a right angle so as to act on a log being fed into said splitting mechanism in a manner to cause the log to move toward said main splitter.

7. A log splitter according to claim 6 wherein said cutting knives are arranged with the straight side of the straight-sided wedge construction of each cutting knife facing in the same direction, said straight sides of said cutting knives extending in planes such that the straight sides of any two transversely adjacent cutting knives diverge relative to one another so as to allow for separation of adjacent split log pieces to prevent binding or jamming thereof.

8. A log splitter according to claim 2 including a side plate extending along said path of travel in spaced apart relation to said main splitter, said cutting knives extending between said main splitter and said side plate and being supported thereon, and a base having said main splitter and said side plate secured thereto to form a rigid unitary frame structure including said cutting knives.

9. A log splitter according to claim 8 wherein said side plate has a cutting edge facing the forward end of a log fed along said path of travel, said cutting edge of said side plate being formed by a straight-sided wedge construction.

10. A log splitter according to claim 9 wherein the straight side of said side plate wedge construction faces the straight side of said main splitter and the planes of said straight sides of said main splitter and said side plate diverge relative to one another in the direction of travel of the log along said path of travel.

11. A log splitter according to claim 9 wherein there are provided four of said cutting knives cooperating with said main splitter and said side plate to define four shearing compartments, said cutting edge of said side plate extending at an angle to the path of travel of the log so as to engage a log progressively as it is fed through the splitting mechanism.

12. A log splitter according to claim 1 wherein said means for feeding a log along said path of travel comprises means for guiding the log as it moves along said path of travel and power operated means for pushing the log into said splitting mechanism.

13. A log splitter according to claim 12 wherein said power operated means comprises a hydraulically operated ram means.

14. A log splitter according to claim 8 including a throwaway plate extending at an angle to said main splitter from the side opposite the cutting knives and from a location spaced rearwardly of said cutting edge of said main splitter so as to move the portion of the log that is not passing through the cutting knives quickly away from the splitting mechanism.

15. A log splitter according to claim 13 including a hitch means on said ram adapted to be engaged by a cable or the like.

16. A log splitting mechanism according to claim 1 wherein said cutting knives are arranged to be set back progressively from one another along said path of travel of the log so that a log moving through said splitting mechanism will come into contact with said cutting knives successively.

* * * * *